US008535800B2

(12) United States Patent
Bovenschen et al.

(10) Patent No.: US 8,535,800 B2
(45) **Date of Patent: *Sep. 17, 2013**

(54) BALLISTIC RESISTANT ARTICLES COMPRISING ELONGATE BODIES

(75) Inventors: Soon Joo Bovenschen, Arnhem (NL); Marinus Johannes Gerardus Journee, Loo (NL); Joris Van Der Eem, Arnhem (NL); Erik Oscar Nienhuis, 's-Heerenberg (NL); Johannes Bos, Apeldoorn (NL)

(73) Assignee: Teijin Aramid B.V., Arnhem (NL)

( * ) Notice: Subject to any disclaimer, the term of this patent is extended or adjusted under 35 U.S.C. 154(b) by 0 days.

This patent is subject to a terminal disclaimer.

(21) Appl. No.: 13/467,729

(22) Filed: May 9, 2012

(65) Prior Publication Data

US 2012/0216669 A1 Aug. 30, 2012

Related U.S. Application Data

(63) Continuation of application No. 13/054,618, filed as application No. PCT/EP2009/058992 on Jul. 14, 2009, now Pat. No. 8,197,935.

(30) Foreign Application Priority Data

Jul. 17, 2008 (EP) ..... 08160594
Jan. 9, 2009 (EP) ..... 09150306

(51) Int. Cl.
*D02G 3/00* (2006.01)

(52) U.S. Cl.
USPC ..... 428/364; 428/292.1; 428/297.4; 428/300.7; 428/394

(58) Field of Classification Search
USPC ..... 428/364, 394, 212, 221, 292.1, 297.4, 428/300.7
See application file for complete search history.

(56) References Cited

U.S. PATENT DOCUMENTS

| | | | | |
|---|---|---|---|---|
| 4,344,908 | A | 8/1982 | Smith et al. | |
| 4,953,234 | A * | 9/1990 | Li et al. | 2/412 |
| 5,106,555 | A | 4/1992 | Kobayashi et al. | |
| 5,106,558 | A | 4/1992 | Kobayashi et al. | |
| 5,167,876 | A * | 12/1992 | Lem et al. | 252/602 |
| 5,284,411 | A * | 2/1994 | Enomoto et al. | 414/217 |
| 5,503,791 | A | 4/1996 | Fortuin et al. | |
| 5,578,373 | A | 11/1996 | Kobayashi et al. | |
| 5,756,660 | A | 5/1998 | Shiraishi et al. | |
| 6,017,480 | A | 1/2000 | Yoshida et al. | |
| 6,265,504 | B1 * | 7/2001 | Liu et al. | 526/161 |
| 6,794,033 | B2 * | 9/2004 | Morin et al. | 428/394 |
| 6,863,976 | B2 * | 3/2005 | Morin et al. | 428/364 |
| 6,951,685 | B1 | 10/2005 | Weedon et al. | |
| 7,671,159 | B2 * | 3/2010 | Rastogi et al. | 526/352 |
| 7,740,779 | B2 * | 6/2010 | Harding et al. | 264/120 |
| 7,964,266 | B2 * | 6/2011 | Harding et al. | 428/156 |
| 7,976,930 | B2 | 7/2011 | Weedon et al. | |
| 7,993,715 | B2 | 8/2011 | Geva et al. | |
| 8,197,935 | B2 * | 6/2012 | Bovenschen et al. | 428/364 |
| 2001/0053443 | A1 | 12/2001 | Perez et al. | |
| 2003/0127768 | A1 | 7/2003 | Morin et al. | |
| 2004/0267313 | A1 | 12/2004 | Amery et al. | |
| 2006/0142521 | A1 * | 6/2006 | Rastogi et al. | 526/352 |
| 2010/0144224 | A1 | 6/2010 | De Weijer et al. | |
| 2011/0124835 | A1 | 5/2011 | De Weijer et al. | |
| 2011/0268951 | A1 | 11/2011 | Eem Van Der et al. | |
| 2011/0268952 | A1 | 11/2011 | Eem Van Der et al. | |

FOREIGN PATENT DOCUMENTS

| | | | |
|---|---|---|---|
| EP | 0 231 547 | A1 | 8/1987 |
| EP | 0 269 151 | A1 | 6/1988 |
| EP | 0 292 074 | A1 | 11/1988 |
| EP | 0 374 785 | A1 | 6/1990 |
| EP | 0 874 005 | A1 | 10/1998 |
| EP | 0 833 742 | B1 | 9/2002 |
| EP | 1 627 719 | A1 | 2/2006 |
| EP | 1 746 187 | A1 | 1/2007 |
| EP | 2 014 445 | A1 | 1/2009 |
| JP | A-6-10254 | | 1/1994 |
| JP | A-8-26487 | | 1/1996 |
| JP | A-2002-180324 | | 6/2002 |
| WO | WO 86/05739 | A1 | 10/1986 |
| WO | WO 91/12136 | A1 | 8/1991 |
| WO | WO 97/00766 | A1 | 1/1997 |
| WO | WO 01/21668 | A1 | 3/2001 |
| WO | WO 2004/113057 | A1 | 12/2004 |
| WO | WO 2006/107197 | A1 | 10/2006 |
| WO | WO 2007/122010 | A2 | 11/2007 |
| WO | WO 2009/007045 | A1 | 1/2009 |

OTHER PUBLICATIONS

Ihara et al., "Single site polymerization of ethylene and 1-olefins initiated by rare earth metal complexes," Macromol. Chem. Phys., vol. 197, pp. 1909-1917, 1996, Hüthig & Wepf Verlag, Zug.
Rastogi et al., "Heterogeneity in polymer melts from melting ofpolymer crystals," *Nature Materials*, vol. 4, Aug. 2005,pp. 635-641, Nature Publishing Group.
Lippits, "Controlling the melting kinetics of polymers; a route to a new melt state," PhD thesis paper at Eindhoven University of Technology, Mar. 6, 2007, pp. 1-157.
Sep. 29, 2009 International Search Report issued in PCT/EP2009/058992.
Sep. 29, 2009 Written Opinion issued in PCT/EP2009/058992.
Mitani, M., et al., "Unprecedented Living Olefin Polymerization Derived from an Attractive Interaction between a Ligand and a Growing Polymer Chain," Chem. Eur. J., 2003, pp. 2396-2403, vol. 9.
Wang, L., et al., "Rolling and Roll-Drawing of Ultrahigh Molecular Weight Polyethylene Reactor Powders," Journal of Applied Polymer Science, Oct. 20, 1991, pp. 1559-1564, vol. 43.
van der Werff et al., "Tensile deformation of high strength and high modulus polyethylene fibers," Colloid Polymer Science, vol. 269, pp. 747-763, 1991.

(Continued)

*Primary Examiner* — N. Edwards
(74) *Attorney, Agent, or Firm* — Oliff & Berridge, PLC

(57) ABSTRACT

A ballistic-resistant molded article having a compressed stack of sheets including reinforcing elongate bodies, where at least some of the elongate bodies are polyethylene elongate bodies that have a weight average molecular weight of at least 100,000 gram/mole. Methods for manufacturing ballistic-resistant molded articles are also provided.

19 Claims, No Drawings

(56) References Cited

OTHER PUBLICATIONS

Oct. 5, 2009 International Search Report and Written Opinion issued in International Application No. PCT/EP2009/058641.
Mar. 16, 2010 International Search Report and Written Opinion issued in International Application No. PCT/EP2010/050063.
Jul. 2, 2010 International Search Report and Written Opinion issued in International Application No. PCT/EP2010/050065.
Feb. 5, 2009 European Search Report issued in European Application No. 08160053.8.
Sep. 5, 2008 International Search Report issued in International Application No. PCT/EP2008/005385.
Jun. 19, 2012 Office Action issued in U.S. Appl. No. 12/452,526.
Third Party Submission dated Oct. 5, 2012 from Japanese Patent Application No. 2011-517906.

* cited by examiner

BALLISTIC RESISTANT ARTICLES COMPRISING ELONGATE BODIES

PRIORITY INFORMATION

This application is a continuation application of U.S. patent application Ser. No. 13/054,618, filed on Jan. 18, 2011, which is the U.S. National Stage of PCT/EP2009/058992, filed on Jul. 14, 2009, the entire disclosures of which are hereby incorporated by reference.

BACKGROUND TO THE INVENTION

Ballistic resistant articles comprising elongate bodies are known in the art.

EP833742 describes a ballistic resistant molded article containing a compressed stack of monolayers, with each monolayer containing unidirectionally oriented fibers and at most 30 wt. % of an organic matrix material.

WO2006/107197 describes a method for manufacturing a laminate of polymeric tapes in which polymeric tapes of the core-cladding type are used, in which the core material has a higher melting temperature than the cladding material, the method comprising the steps of biasing the polymeric tapes, positioning the polymeric tapes, and consolidating the polymeric tapes to obtain a laminate.

EP 1627719 describes a ballistic resistant article consisting essentially of ultra-high molecular weight polyethylene which comprises a plurality of unidirectionally oriented polyethylene sheets cross-plied at an angle with respect to each other and attached to each other in the absence of any resin, bonding matrix, or the like.

U.S. Pat. No. 4,953,234 describes an impact-resistant composite and helmet made thereof. The composite comprises a plurality of pre-preg packets, each comprising at least two layers of cross-plied layers of unidirectional coplanar fibers embedded in a matrix. The fibers may be highly oriented high molecular weight polyethylene fibers.

U.S. Pat. No. 5,167,876 describes a fire retardant composition comprising at least one fibrous layer comprising a network of fibers such as high-strength polyethylene or aramid fibers in a matrix in combination with a fire-retardant layer.

While the references mentioned above describe ballistic-resistant materials with adequate properties, there is still room for improvement. More in particular, there is need for a ballistic resistant material which combines a high ballistic performance with a low areal weight and a good stability. The present invention provides such a material.

SUMMARY OF THE INVENTION

The present invention pertains to a ballistic-resistant molded article comprising a compressed stack of sheets comprising reinforcing elongate bodies wherein at least some of the elongate bodies are polyethylene elongate bodies which have a weight average molecular weight of at least 100,000 gram/mole and an Mw/Mn ratio of at most 6.

The present invention also pertains to a method for manufacturing a ballistic-resistant molded article comprising the steps of providing sheets comprising reinforcing elongate bodies, stacking the sheets in such a manner that the direction of the elongate bodies within the compressed stack is not unidirectionally, and compressing the stack under a pressure of at least 0.5 MPa, wherein at least some of the elongate bodies are polyethylene elongate bodies which have a weight average molecular weight of at least 100,000 gram/mole and a Mw/Mn ratio of at most 6.

DETAILED DESCRIPTION

A key feature of the present invention is that at least some of the elongate bodies present in the ballistic material are polyethylene elongate bodies which have a weight average molecular weight of at least 100,000 gram/mole, and an Mw/Mn ratio of at most 6.

It has been found that the selection of elongate bodies meeting these criteria results in a molded ballistic material with particularly advantageous properties. More in particular, the selection of a material with a narrow molecular weight distribution was found to in a material with improved ballistic properties. Further advantageous embodiments of the present invention will become clear from the further specification.

It is noted that polyethylene with a weight average molecular weight of at least 100,000 gram/mole, and an Mw/Mn ratio of at most 6 is in itself known in the art. It is for example described in WO2001/21668. This reference indicates that the polymer described therein has improved environmental stress-crack resistance, moisture-barrier properties, chemical resistance, impact resistance, abrasion resistance, and mechanical strength. It is indicated that the material can be used to make film, pressure pipe, large-part blown molding, extruded sheet, and many other articles. However, this reference does not contain any further information on these properties, and nether discloses or suggests the use of elongate bodies of this material in ballistic applications.

Ihara et al. (E. Ihara et al., Marcomol. Chem. Phys. 197, 1909-1917 (1996)) describes a process for manufacturing polyethylene with a molecular weight Mn of above 1 million and a Mw/Mn ratio of 1.60.

Within the context of the present specification the word elongate body means an object the largest dimension of which, the length, is larger than the second smallest dimension, the width, and the smallest dimension, the thickness. More in particular, the ratio between the length and the width generally is at least 10. The maximum ratio is not critical to the present invention and will depend on processing parameters. As a general value, a maximum length to width ratio of 1,000,000 may be mentioned.

Accordingly, the elongate bodies used in the present invention encompass monofilaments, multifilament yarns, threads, tapes, strips, staple fiber yarns and other elongate objects having a regular or irregular cross-section.

In one embodiment of the present invention, the elongate body is a fiber, that is, an object of which the length is larger than the width and the thickness, while the width and the thickness are within the same size range. More in particular, the ratio between the width and the thickness generally is in the range of 10:1 to 1:1, still more in particular between 5:1 and 1:1, still more in particular between 3:1 and 1:1. As the skilled person will understand, the fibers may have a more or less circular cross-section. In this case, the width is the largest dimension of the cross-section, while the thickness is the shortest dimension of the cross section.

For fibers, the width and the thickness are generally at least 1 micron, more in particular at least 7 micron. In the case of multifilament yarns the width and the thickness may be quite large, e.g., up to 2 mm. For monofilament yarns a width and thickness of up to 150 micron may be more conventional. As a particular example, fibers with a width and thickness in the range of 7-50 microns may be mentioned.

In the present invention, a tape is defined as an object of which the length, i.e., the largest dimension of the object, is larger than the width, the second smallest dimension of the object, and the thickness, i.e., the smallest dimension of the object, while the width is in turn larger than the thickness. More in particular, the ratio between the length and the width generally is at least 2, Depending on tape width and stack size the ratio may be larger, e.g., at least 4, or at least 6. The maximum ratio is not critical to the present invention and will depend on processing parameters. As a general value, a maximum length to width ratio of 200,000 may be mentioned. The ratio between the width and the thickness generally is more than 10:1, in particular more than 50:1, still more in particular more than 100:1. The maximum ratio between the width and the thickness is not critical to the present invention. It generally is at most 2,000:1.

The width of the tape generally is at least 1 mm, more in particular at least 2 mm, still more in particular at least 5 mm, more in particular at least 10 mm, even more in particular at least 20 mm, even more in particular at least 40 mm. The width of the tape is generally at most 200 mm. The thickness of the tape is generally at least 8 microns, in particular at least 10 microns. The thickness of the tape is generally at most 150 microns, more in particular at most 100 microns.

In one embodiment, tapes are used with a high strength in combination with a high linear density. In the present application the linear density is expressed in dtex. This is the weight in grams of 10.000 meters of film. In one embodiment, the film according to the invention has a denier of at least 3,000 dtex, in particular at least 5,000 dtex, more in particular at least 10,000 dtex, even more in particular at least 15,000 dtex, or even at least 20,000 dtex, in combination with strengths of, as specified above, at least 2.0 GPa, in particular at least 2.5 GPA, more in particular at least 3.0 GPa, still more in particular at least 3.5 GPa, and even more in particular at least 4 GPa.

The use of tapes has been found to be particularly attractive within the present invention because it enables the manufacture of ballistic materials with very good ballistic performance, good peel strength, and low areal weight.

Within the present specification, the term sheet refers to an individual sheet comprising elongate bodies, which sheet can individually be combined with other, corresponding sheets. The sheet may or may not comprise a matrix material, as will be elucidated below.

As indicated above, at least some of the elongate bodies in the ballistic-resistant molded article are polyethylene elongated bodies meeting the stated requirements. To obtain the effect of the present invention, it is preferred for at least 20 wt. %, calculated on the total weight of the elongated bodies present in the ballistic resistant molded article, of the elongated bodies to be polyethylene elongate bodies meeting the requirements of the present invention, in particular at least 50 wt. %. More in particular, at least 75 wt. %, still more in particular at least 85 wt. %, or at least 95 wt. % of the elongated bodies present in the ballistic resistant molded article meets said requirements. In one embodiment, all of the elongated bodies present in the ballistic resistant molded article meet said requirements.

The polyethylene elongate bodies used in the present invention have a weight average molecular weight (Mw) of at least 100,000 gram/mole, in particular at least 300,000 gram/mole, more in particular at least 400,000 gram/mole, still more in particular at least 500,000 gram/mole, in particular between $1.10^6$ gram/mole and $1.10^8$ gram/mole. The molecular weight distribution and molecular weight averages (Mw, Mn, Mz) are determined in accordance with ASTM D 6474-99 at a temperature of 160° C. using 1,2,4-trichlorobenzene (TCB) as solvent. Appropriate chromatographic equipment (PL-GPC220 from Polymer Laboratories) including a high temperature sample preparation device (PL-SP260) may be used. The system is calibrated using sixteen polystyrene standards (Mw/Mn<1.1) in the molecular weight range $5*10^3$ to $8*10^6$ gram/mole.

The molecular weight distribution may also be determined using melt rheometry. Prior to measurement, a polyethylene sample to which 0.5 wt % of an antioxidant such as IRGANOX 1010 has been added to prevent thermo-oxidative degradation, would first be sintered at 50° C. and 200 bars. Disks of 8 mm diameter and thickness 1 mm obtained from the sintered polyethylenes are heated fast (~30° C./min) to well above the equilibrium melting temperature in the rheometer under nitrogen atmosphere. For an example, the disk was kept at 180 C for two hours or more. The slippage between the sample and rheometer discs may be checked with the help of an oscilloscope. During dynamic experiments two output signals from the rheometer i.e. one signal corresponding to sinusoidal strain, and the other signal to the resulting stress response, are monitored continuously by an oscilloscope. A perfect sinusoidal stress response, which can be achieved at low values of strain was an indicative of no slippage between the sample and discs.

Rheometry may be carried out using a plate-plate rheometer such as Rheometrics RMS 800 from TA Instruments. The Orchestrator Software provided by the TA Instruments, which makes use of the Mead algorithm, may be used to determine molar mass and molar mass distribution from the modulus vs frequency data determined for the polymer melt. The data is obtained under isothermal conditions between 160-220° C. To get the good fit angular frequency region between 0.001 to 100 rad/s and constant strain in the linear viscoelastic region between 0.5 to 2% should be chosen. The time-temperature superposition is applied at a reference temperature of 190° C. To determine the modulus below 0.001 frequency (rad/s) stress relaxation experiments may be performed. In the stress relaxation experiments, a single transient deformation (step strain) to the polymer melt at fixed temperature is applied and maintained on the sample and the time dependent decay of stress is recorded.

The molecular weight distribution of the polyethylene present in the elongate bodies used in the ballistic material of the present invention is relatively narrow. This is expressed by the Mw (weight average molecular weight) over Mn (number average molecular weight) ratio of at most 6. More in particular the Mw/Mn ratio is at most 5, still more in particular at most 4, even more in particular at most 3. The use of materials with an Mw/Mn ratio of at most 2.5, or even at most 2 is envisaged in particular.

For application of the elongate bodies in ballistic-resistant molded parts it is essential that the bodies be ballistically effective. This is the case for elongate bodies which meet the criteria for molecular weight and Mw/Mn ratio as discussed above. Ballistic effectivity of the material will be increased when the additional parameters and preferred values discussed in this specification will be met.

In addition to the molecular weight and the Mw/Mn ratio, the elongate bodies used in the ballistic material of the present invention generally have a high tensile strength, a high tensile modulus and a high energy absorption, reflected in a high energy-to-break.

In one embodiment, the tensile strength of the elongate bodies is at least 2.0 GPa, in particular at least 2.5 GPa, more in particular at least 3.0 GPa, still more in particular at least 4 GPa. Tensile strength is determined in accordance with ASTM D882-00.

In another embodiment, the elongate bodies have a tensile modulus of at least 80 GPa. The modulus is determined in accordance with ASTM D822-00. More in particular, the elongate bodies may have a tensile modulus of at least 100 GPa, still more in particular at least 120 GPa, even more in particular at least 140 GPa, or at least 150 GPa.

In another embodiment, the elongate bodies have a tensile energy to break of at least 30 J/g, in particular at least 35 J/g, more in particular at least 40 J/g, still more in particular at least 50 J/g. The tensile energy to break is determined in accordance with ASTM D882-00 using a strain rate of 50%/min. It is calculated by integrating the energy per unit mass under the stress-strain curve.

In a preferred embodiment of the present invention the polyethylene elongate bodies have a high molecular orientation as is evidenced by their XRD diffraction pattern.

In one embodiment of the present invention, tapes are used in the ballistic material which have a 200/110 uniplanar orientation parameter Φ of at least 3. The 200/110 uniplanar orientation parameter Φ is defined as the ratio between the 200 and the 110 peak areas in the X-ray diffraction (XRD) pattern of the tape sample as determined in reflection geometry.

Wide angle X-ray scattering (WAXS) is a technique that provides information on the crystalline structure of matter. The technique specifically refers to the analysis of Bragg peaks scattered at wide angles. Bragg peaks result from long-range structural order. A WAXS measurement produces a diffraction pattern, i.e. intensity as function of the diffraction angle 2θ (this is the angle between the diffracted beam and the primary beam).

The 200/110 uniplanar orientation parameter gives information about the extent of orientation of the 200 and 110 crystal planes with respect to the tape surface. For a tape sample with a high 200/110 uniplanar orientation the 200 crystal planes are highly oriented parallel to the tape surface. It has been found that a high uniplanar orientation is generally accompanied by a high tensile strength and high tensile energy to break. The ratio between the 200 and 110 peak areas for a specimen with randomly oriented crystallites is around 0.4. However, in the tapes that are preferentially used in one embodiment of the present invention the crystallites with indices 200 are preferentially oriented parallel to the film surface, resulting in a higher value of the 200/110 peak area ratio and therefore in a higher value of the uniplanar orientation parameter.

The value for the 200/110 uniplanar orientation parameter may be determined using an X-ray diffractometer. A Bruker-AXS D8 diffractometer equipped with focusing multilayer X-ray optics (Gael mirror) producing Cu-Kα radiation (K wavelength=1.5418) is suitable. Measuring conditions: 2 mm anti-scatter slit, 0.2 mm detector slit and generator setting 40 kV, 35 mA. The tape specimen is mounted on a sample holder, e.g., with some double-sided mounting tape. The preferred dimensions of the tape sample are 15 mm×15 mm (l×w). Care should be taken that the sample is kept perfectly flat and aligned to the sample holder. The sample holder with the tape specimen is subsequently placed into the D8 diffractometer in reflection geometry (with the normal of the tape perpendicular to the goniometer and perpendicular to the sample holder). The scan range for the diffraction pattern is from 5° to 40° (2θ) with a step size of 0.02° (2θ) and a counting time of 2 seconds per step. During the measurement the sample holder spins with 15 revolutions per minute around the normal of the tape, so that no further sample alignment is necessary. Subsequently the intensity is measured as function of the diffraction angle 2θ. The peak area of the 200 and 110 reflections is determined using standard profile fitting software, e.g. Topas from Bruker-AXS. As the 200 and 110 reflections are single peaks, the fitting process is straightforward and it is within the scope of the skilled person to select and carry out an appropriate fitting procedure. The 200/110 uniplanar orientation parameter is defined as the ratio between the 200 and 110 peak areas. This parameter is a quantitative measure of the 200/110 uniplanar orientation.

As indicated above, the tapes used in one embodiment of the ballistic material according to the invention have a 200/110 uniplanar orientation parameter of at least 3. It may be preferred for this value to be at least 4, more in particular at least 5, or at least 7. Higher values, such as values of at least 10 or even at least 15 may be particularly preferred. The theoretical maximum value for this parameter is infinite if the peak area 110 equals zero. High values for the 200/110 uniplanar orientation parameter are often accompanied by high values for the strength and the energy to break.

In one embodiment of the present invention, fibers are used in the ballistic material which have a 020 uniplanar orientation parameter of at most 55°. The 020 uniplanar orientation parameter gives information about the extent of orientation of the 020 crystal planes with respect to the fiber surface.

The 020 uniplanar orientation parameter is measured as follows. The sample is placed in the goniometer of the diffractometer with the machine direction perpendicular to the primary X-ray beam. Subsequently the intensity (i.e. the peak area) of the 020 reflection is measured as function of the goniometer rotation angle Φ. This amounts to a rotation of the sample around its long axis (which coincides with the machine direction) of the sample. This results in the orientation distribution of the crystal planes with indices 020 with respect to the filament surface. The 020 uniplanar orientation parameter is defined as the Full Width at Half Maximum (FWHM) of the orientation distribution.

The measurement can be carried out using a Bruker P4 with HiStar 2D detector, which is a position-sensitive gas-filled multi-wire detector system. This diffractometer is equipped with graphite monochromator producing Cu—Kα radiation (K wavelength=1.5418 Å). Measuring conditions: 0.5 mm pinhole collimator, sample-detector distance 77 mm, generator setting 40 kV, 40 mA and at least 100 seconds counting time per image.

The fiber specimen is placed in the goniometer of the diffractometer with its machine direction perpendicular to the primary X-ray beam (transmission geometry). Subsequently the intensity (i.e. the peak area) of the 020 reflection is measured as function of the goniometer rotation angle Φ. The 2D diffraction patterns are measured with a step size of 1° (Φ) and counting time of at least 300 seconds per step.

The measured 2D diffraction patterns are corrected for spatial distortion, detector non-uniformity and air scattering using the standard software of the apparatus. It is within the scope of the skilled person to effect these corrections. Each 2-dimensional diffraction pattern is integrated into a 1-dimensional diffraction pattern, a so-called radial 2θ curve. The peak area of the 020 reflections is determined by a standard profile fitting routine, with is well within the scope of the skilled person. The 020 uniplanar orientation parameter is the FWHM in degrees of the orientation distribution as determined by the peak area of the 020 reflection as function of the rotation angle Φ of the sample.

As indicated above, in one embodiment of the present invention fibers are used which have a 020 uniplanar orientation parameter of at most 55°. The 020 uniplanar orientation parameter preferably is at most 45°, more preferably at most 30°. In some embodiments the 020 uniplanar orientation value may be at most 25°. It has been found that fibers which have a 020 uniplanar orientation parameter within the stipulated range have a high strength and a high elongation at break.

Like the 200/110 uniplanar orientation parameter, the 020 uniplanar orientation parameter is a measure for the orientation of the polymers in the fiber. The use of two parameters derives from the fact that the 200/110 uniplanar orientation parameter cannot be used for fibers because it is not possible position a fiber sample adequately in the apparatus. The 200/110 uniplanar orientation parameter is suitable for application onto bodies with a width of 0.5 mm or more. On the other hand, the 020 uniplanar orientation parameter is in principle suitable for materials of all widths, thus both for fibers and for tapes. However, this method is less practical in operation than the 200/110 method. Therefore, in the present specification the 020 uniplanar orientation parameter will be used only for fibers with a width smaller than 0.5 mm.

In one embodiment of the present invention, the elongate bodies used therein have a DSC crystallinity of at least 74%, more in particular at least 80%. The DSC crystallinity can be determined as follows using differential scanning calorimetry (DSC), for example on a Perkin Elmer DSC7. Thus, a sample of known weight (2 mg) is heated from 30 to 180° C. at 10° C. per minute, held at 180° C. for 5 minutes, then cooled at 10° C. per minute. The results of the DSC scan may be plotted as a graph of heat flow (mW or mJ/s; y-axis) against temperature (x-axis). The crystallinity is measured using the data from the heating portion of the scan. An enthalpy of fusion ΔH (in J/g) for the crystalline melt transition is calculated by determining the area under the graph from the temperature determined just below the start of the main melt transition (endotherm) to the temperature just above the point where fusion is observed to be completed. The calculated ΔH is then compared to the theoretical enthalpy of fusion ($\Delta H_c$ of 293 J/g) determined for 100% crystalline PE at a melt temperature of approximately 140° C. A DSC crystallinity index is expressed as the percentage $100(\Delta H/\Delta H_c)$. In one embodiment, the elongate bodies used in the present invention have a DSC crystallinity of at least 85%, more in particular at least 90%.

The UHMWPE used in the present invention may have a bulk density which is significantly lower than the bulk density of conventional UWMWPEs. More in particular, the UHMWPE used in the process according to the invention may have a bulk density below 0.25 g/cm$^3$, in particular below 0.18 g/cm$^3$, still more in particular below 0.13 g/cm$^3$. The bulk density may be determined in accordance with is determined in accordance with ASTM-D1895. A fair approximation of this value can be obtained as follows. A sample of UHMWPE powder is poured into a measuring beaker of exact 100 ml. After scraping away the surplus of material, the weight of the content of the beaker is determined and the bulk density is calculated.

The polyethylene used in the present invention can be a homopolymer of ethylene or a copolymer of ethylene with a co-monomer which is another alpha-olefin or a cyclic olefin, both with generally between 3 and 20 carbon atoms. Examples include propene, 1-butene, 1-pentene, 1-hexene, 1-heptene, 1-octene, cyclohexene, etc. The use of dienes with up to 20 carbon atoms is also possible, e.g., butadiene or 1-4 hexadiene. The amount of non-ethylene alpha-olefin in the ethylene homopolymer or copolymer used in the process according to the invention preferably is at most 10 mole %, preferably at most 5 mole %, more preferably at most 1 mole %. If a non-ethylene alpha-olefin is used, it is generally present in an amount of at least 0.001 mol. %, in particular at least 0.01 mole %, still more in particular at least 0.1 mole %. The use of a material which is substantially free from non-ethylene alpha-olefin is preferred. Within the context of the present specification, the wording substantially free from non-ethylene alpha-olefin is intended to mean that the only amount non-ethylene alpha-olefin present in the polymer are those the presence of which cannot reasonably be avoided.

In general, the elongate bodies used in the present invention have a polymer solvent content of less than 0.05 wt. %, in particular less than 0.025 wt. %, more in particular less than 0.01 wt. %.

In one embodiment of the present invention, the elongate bodies are tapes manufactured by a process which comprises subjecting a starting polyethylene with a weight average molecular weight of at least 100,000 gram/mole, an elastic shear modulus $G_N^0$, determined directly after melting at 160° C. of at most 1.4 MPa, and a Mw/Mn ratio of at most 6 to a compacting step and a stretching step under such conditions that at no point during the processing of the polymer its temperature is raised to a value above its melting point.

The starting material for said manufacturing process is a highly disentangled UHMWPE. This can be seen from the combination of the weight average molecular weight, the Mw/Mn ratio, the elastic modulus, and the fact that the elastic shear modulus of the material increases after first melting. For further elucidation and preferred embodiments as regards the molecular weight and the Mw/Mn ratio of the starting polymer, reference is made to what has been stated above. In particular, in this process it is preferred for the starting polymer to have a weight average molecular weight of at least 500,000 gram/mole, in particular between $1.10^6$ gram/mole and $1.10^8$ gram/mole.

As indicated above, the starting polymer has an elastic shear modulus $G_N^0$ determined directly after melting at 160° C. of at most 1.4 MPa, more in particular at most 1.0 MPa, still more in particular at most 0.9 MPa, even more in particular at most 0.8 MPa, and even more in particular at most 0.7. The wording "directly after melting" means that the elastic modulus is determined as soon as the polymer has melted, in particular within 15 seconds after the polymer has melted. For this polymer melt, the elastic modulus typically increases from 0.6 to 2.0 MPa in one, two, or more hours, depending on the molar mass.

The elastic shear modulus directly after melting at 160° C. is a measure for the degree of entangledness of the polymer. $G_N^0$ is the elastic shear modulus in the rubbery plateau region. It is related to the average molecular weight between entanglements Me, which in turn is inversely proportional to the entanglement density. In a thermodynamically stable melt having a homogeneous distribution of entanglements, Me can be calculated from $G_N^0$ via the formula $G_N^0=g_N\rho RT/M_e$, where $g_N$ is a numerical factor set at 1, rho is the density in g/cm3, R is the gas constant and T is the absolute temperature in K.

A low elastic modulus thus stands for long stretches of polymer between entanglements, and thus for a low degree of entanglement. The adopted method for the investigation on changes in $G_N^0$ with the entanglements formation is the same as described in publications (Rastogi, S., Lippits, D., Peters, G., Graf, R., Yefeng, Y. and Spiess, H., "Heterogeneity in Polymer Melts from Melting of Polymer Crystals", Nature Materials, 4(8), 1 Aug. 2005, 635-641 and PhD thesis Lippits, D. R., "Controlling the melting kinetics of polymers; a route to a new melt state", Eindhoven University of Technology, dated 6 Mar. 2007, ISBN 978-90-386-0895-2).

The starting polymer for use in the present invention may be manufactured by a polymerization process wherein ethylene, optionally in the presence of other monomers as discussed above, is polymerized in the presence of a single-site polymerization catalyst at a temperature below the crystallization temperature of the polymer, so that the polymer crystallizes immediately upon formation. This will lead to a material with an Mw/Mn ratio in the claimed range.

In particular, reaction conditions are selected such that the polymerization speed is lower than the crystallization speed. These synthesis conditions force the molecular chains to crystallize immediately upon their formation, leading to a rather unique morphology which differs substantially from the one obtained from the solution or the melt. The crystalline morphology created at the surface of a catalyst will highly depend on the ratio between the crystallization rate and the growth rate of the polymer. Moreover, the temperature of the synthesis, which is in this particular case also crystallization temperature, will strongly influence the morphology of the obtained UHMW-PE powder. In one embodiment the reaction temperature is between −50 and +50° C., more in particular between −15 and +30° C. It is well within the scope of the skilled person to determine via routine trial and error which reaction temperature is appropriate in combination with which type of catalyst, polymer concentrations and other parameters influencing the reaction.

To obtain a highly disentangled UHMWPE it is important that the polymerization sites are sufficiently far removed from each other to prevent entangling of the polymer chains during synthesis. This can be done using a single-site catalyst which is dispersed homogenously through the crystallization medium in low concentrations. More in particular, concentrations less than 1.10-4 mol catalyst per liter, in particular less than 1.10-5 mol catalyst per liter reaction medium may be appropriate. Supported single site catalyst may also be used, as long as care is taken that the active sites are sufficiently far removed from each other to prevent substantial entanglement of the polymers during formation. Suitable methods for manufacturing polyethylenes used in the present invention are known in the art. Reference is made, for example, to WO01/21668 and US20060142521.

In this manufacturing process the polymer is provided in particulate form, for example in the form of a powder. The polymer is provided in particulate form, for example in the form of a powder, or in any other suitable particulate form. Suitable particles have a particle size of up to 5,000 micron, preferably up to 2,000 micron, more in particular up to 1,000 micron. The particles preferably have a particle size of at least 1 micron, more in particular at least 10 micron.

The particle size distribution may be determined by laser diffraction (PSD, Sympatec Quixel) as follows. The sample is dispersed into surfactant-containing water and treated ultrasonic for 30 seconds to remove agglomerates/entanglements. The sample is pumped through a laser beam and the scattered light is detected. The amount of light diffraction is a measure for the particle size.

The compacting step is carried out to integrate the polymer particles into a single object, e.g., in the form of a mother sheet. The stretching step is carried out to provide orientation to the polymer and manufacture the final product. The two steps are carried out at a direction perpendicular to each other. It is noted that these elements may be combined in a single step, or may be carried out in separate steps, each step performing one or more of the compacting and stretching elements. For example, in one embodiment the process comprises the steps of compacting the polymer powder to form a mothersheet, rolling the plate to form rolled mothersheet and subjecting the rolled mothersheet to a stretching step to form a polymer film.

The compacting force applied in the process according to the invention generally is 10-10,000 N/cm$^2$, in particular 50-5,000 N/cm$^2$, more in particular 100-2,000 N/cm$^2$. The density of the material after compacting is generally between 0.8 and 1 kg/dm$^3$, in particular between 0.9 and 1 kg/dm$^3$.

The compacting and rolling step is generally carried out at a temperature of at least 1° C. below the unconstrained melting point of the polymer, in particular at least 3° C. below the unconstrained melting point of the polymer, still more in particular at least 5° C. below the unconstrained melting point of the polymer. Generally, the compacting step is carried out at a temperature of at most 40° C. below the unconstrained melting point of the polymer, in particular at most 30° C. below the unconstrained melting point of the polymer, more in particular at most 10° C.

The stretching step is generally carried out at a temperature of at least 1° C. below the melting point of the polymer under process conditions, in particular at least 3° C. below the melting point of the polymer under process conditions, still more in particular at least 5° C. below the melting point of the polymer under process conditions. As the skilled person is aware, the melting point of polymers may depend upon the constraint under which they are put. This means that the melting temperature under process conditions may vary from case to case. It can easily be determined as the temperature at which the stress tension in the process drops sharply. Generally, the stretching step is carried out at a temperature of at most 30° C. below the melting point of the polymer under process conditions, in particular at most 20° C. below the melting point of the polymer under process conditions, more in particular at most 15° C.

In one embodiment, the stretching step encompasses at least two individual stretching steps, wherein the first stretching step is carried out at a lower temperature than the second, and optionally further, stretching steps. In one embodiment, the stretching step encompasses at least two individual stretching steps wherein each further stretching step is carried out at a temperature which is higher than the temperature of the preceding stretching step. As will be evident to the skilled person, this method can be carried out in such a manner that individual steps may be identified, e.g., in the form of the films being fed over individual hot plates of a specified temperature. The method can also be carried out in a continuous manner, wherein the film is subjected to a lower temperature in the beginning of the stretching process and to a higher temperature at the end of the stretching process, with a temperature gradient being applied in between. This embodiment can for example be carried out by leading the film over a hot plate which is equipped with temperature zones, wherein the zone at the end of the hot plate nearest to the compaction apparatus has a lower temperature than the zone at the end of the hot plate furthest from the compaction apparatus. In one embodiment, the difference between the lowest temperature applied during the stretching step and the highest temperature applied during the stretching step is at least 3° C., in particular at least 7° C., more in particular at least 10° C. In general, the difference between the lowest temperature applied during the stretching step and the highest temperature applied during the stretching step is at most 30° C., in particular at most 25° C.

In the conventional processing of UHMWPE it was necessary to carry out the process at a temperature which was very close to the melting temperature of the polymer, e.g., within 1 to 3 degrees therefrom. It has been found that the selection of the specific starting UHMWPE used in the process according to the invention makes it possible to operate at values which are more below the melting temperature of the polymer than has been possible in the prior art. This makes for a larger temperature operating window which makes for better process control.

It has also been found that, as compared to conventional processing of UHMWPE, the polyethylene used in the present invention can be used to manufacture materials with a strength of at least 2 GPa at higher deformation speeds. The deformation speed is directly related to the production capacity of the equipment. For economical reasons it is important to produce at a deformation rate which is as high as possible without detrimentally affecting the mechanical properties of the film. In particular, it has been found that it is possible to manufacture a material with a strength of at least 2 GPa by a process wherein the stretching step that is required to increase the strength of the product from 1.5 GPa to at least 2 GPa is carried out at a rate of at least 4% per second. In conventional polyethylene processing it is not possible to carry out this stretching step at this rate. While in conventional UHMWPE processing the initial stretching steps, to a strength of, say, 1 or 1.5 GPa may be carried out at a rate of above 4% per second, the final steps, required to increase the strength of the film to a value of 2 GPa or higher, must be carried out at a rate well below 4% per second, as otherwise the film will break. In contrast, with the UHMWPE used in the present invention, it has been found that it is possible to stretch intermediate film with a strength of 1.5 GPa at a rate of at least 4% per second, to obtain a material with a strength of at least 2 GPa. For further preferred values of the strength reference is made to what has been stated above. It has been found that the rate applied in this step may be at least 5% per second, at least 7% per second, at least 10% per second, or even at least 15% per second.

The strength of the film is related to the stretching ratio applied. Therefore, this effect can also be expressed as follows. In one embodiment, the stretching step can be carried out in such a manner that the stretching step from a stretching ratio of 80 to a stretching ratio of at least 100, in particular at least 120, more in particular at least 140, still more in particular of at least 160 is carried out at the stretching rate indicated above.

In still a further embodiment, the stretching step can be carried out in such a manner that the stretching step from a material with a modulus of 60 GPa to a material with a modulus of at least at least 80 GPa, in particular at least 100 GPa, more in particular at least 120 GPa, at least 140 GPa, or at least 150 GPa is carried out at the rate indicated above.

In will be evident to the skilled person that the intermediate products with a strength of 1.5 GPa, a stretching ratio of 80, and/or a modulus of 60 GPa are used, respectively, as starting point for the calculation of when the high-rate stretching step starts. This does not mean that a separately identifiable stretching step is carried out where the starting material has the specified value for strength, stretching ratio, or modulus. A product with these properties may be formed as intermediate product during a stretching step. The stretching ratio will then be calculated back to a product with the specified starting properties. It is noted that the high stretching rate described above is dependent upon the requirement that all stretching steps, including the high-rate stretching step or steps are carried out at a temperature below the melting point of the polymer under process conditions.

The unconstrained melting temperature of the starting polymer is between 138 and 142° C. and can easily be determined by the person skilled in the art. With the values indicated above this allows calculation of the appropriate operating temperature. The unconstrained melting point may be determined via DSC (differential scanning calorimetry) in nitrogen, over a temperature range of +30 to +180° C. and with an increasing temperature rate of 10° C./minute. The maximum of the largest endothermic peak at from 80 to 170° C. is evaluated here as the melting point.

Conventional apparatus may be used to carry out the compacting step. Suitable apparatus include heated rolls, endless belts, etc.

The stretching step is carried out to manufacture the polymer film. The stretching step may be carried out in one or more steps in a manner conventional in the art. A suitable manner includes leading the film in one or more steps over a set of rolls both rolling in process direction wherein the second roll rolls faster that the first roll. Stretching can take place over a hot plate or in an air circulation oven.

The total stretching ratio may be at least 80, in particular at least 100, more in particular at least 120, still more in particular at least 140, even more in particular at least 160. The total stretching ratio is defined as the area of the cross-section of the compacted mothersheet divided by the cross-section of the drawn film produced from this mothersheet.

The process is carried out in the solid state. The final polymer film has a polymer solvent content of less than 0.05 wt. %, in particular less than 0.025 wt. %, more in particular less than 0.01 wt. %.

The process as described above will yield tapes. They can be converted into fibers via methods known in the art, e.g., via slitting.

In one embodiment of the present invention the fibers used in the ballistic material according to the invention are manufactured via a process comprising subjecting a polyethylene tape with a weight average molecular weight of at least 100,000 gram/mole, an Mw/Mn ratio of at most 6, and a 200/110 uniplanar orientation parameter of at least 3 to a force in the direction of the thickness of the tape over the whole width of the tape. Again, for further elucidation and preferred embodiments as regards the molecular weight and the Mw/Mn ratio of the starting tape, reference is made to what has been stated above. In particular, in this process it is preferred for the starting material to have a weight average molecular weight of at least 500,000 gram/mole, in particular between $1.10^6$ gram/mole and $1.10^8$ gram/mole.

The application of a force in the direction of the thickness of the tape over the whole width of the tape can be done in a number of ways. For example, the tape may be contacted with an air stream in the direction of the thickness of the tape. For another example, the tape is led over a roll which applies a force onto the tape in the direction of the tape. In a further embodiment, the force is applied by twisting the tape in the longitudinal direction, therewith applying a force in the direction perpendicular to the direction of the tape. In another embodiment, the force is applied by peeling filaments from the tape. In a further embodiment, the tape is contacted with an air tangler.

The force required to convert the tape into fibers does not have to be very strong. While the use of strong forces is not detrimental to the product, it is not required from an operation point of view. Accordingly, in one embodiment, the force applied is lower than 10 bar.

The minimum force required will depend on the properties of the tape, in particular on its thickness and on the value for the 200/110 uniplanar orientation parameter.

The thinner the tape, the lower the force is that will be required to divide the tape into individual fibers. The higher the value for the 200/110 uniplanar orientation parameter, the more the polymers in the tape are oriented in parallel, and the lower the force is that will be required to divide the tape into individual fibers. It is within the scope of the skilled person to determine the lowest possible force. In general, the force is at least 0.1 bar.

Upon application of the force upon the tape as described above, the material divides itself into individual fibers. The dimensions of the individual fibers are generally as follows.

The width of the fibers is generally between 1 micron and 500 micron, in particular between 1 micron and 200 micron, more in particular between 5 micron and 50 micron.

The thickness of the fibers is generally between 1 micron and 100 micron, in particular between 1 micron and 50 micron, more in particular between 1 micron and 25 micron.

The ratio between the width and the thickness is generally between 10:1 and 1:1, more in particular between 5:1 and 1:1, still more in particular between 3:1 and 1:1.

As indicated above, the ballistic-resistant molded article of the present invention comprises a compressed stack of sheets comprising reinforcing elongate bodies, wherein at least some elongate bodies meet the requirements discussed in detail above.

The sheets may encompass the reinforcing elongate bodies as parallel fibers or tapes. When tapes are used, they may be next to each other, but if so desired, they may partially or wholly overlap. The elongate bodies may be formed as a felt, knitted, or woven, or formed into a sheet by any other means.

The compressed stack of sheets may or may not comprise a matrix material. The term "matrix material" means a material which binds the elongate bodies and/or the sheets together. When matrix material is present in the sheet itself, it may wholly or partially encapsulates the elongate bodies in the sheet. When the matrix material is applied onto the surface of the sheet, it will act as a glue or binder to keep the sheets together.

In one embodiment of the present invention, matrix material is provided within the sheets themselves, where it serves to adhere the elongate bodies to each other.

In another embodiment of the present invention, matrix material is provided on the sheet, to adhere the sheet to further sheets within the stacks. Obviously, the combination of these two embodiments is also envisaged.

In one embodiment of the present invention, the sheets themselves contain reinforcing elongate bodies and a matrix material. The manufacture of sheets of this type is known in the art. They are generally manufactured as follows. In a first step, the elongate bodies, e.g., fibers, are provided in a layer, and then a matrix material is provided onto the layer under such conditions that the matrix material causes the bodies to adhere together. In one embodiment, the elongate bodies are provided in a parallel fashion.

In one embodiment, the provision of the matrix material is effected by applying one or more films of matrix material to the surface, bottom or both sides of the plane of elongate bodies and then causing the films to adhere to the elongated bodies, e.g., by passing the films together with the elongate bodies, through a heated pressure roll.

In a preferred embodiment of the present invention, the layer is provided with an amount of a liquid substance containing the organic matrix material of the sheet. The advantage of this is that more rapid and better impregnation of the elongate bodies is achieved. The liquid substance may be for example a solution, a dispersion or a melt of the organic matrix material. If a solution or a dispersion of the matrix material is used in the manufacture of the sheet, the process also comprises evaporating the solvent or dispersant. This can for instance be accomplished by using an organic matrix material of very low viscosity in impregnating the elongate bodies in the manufacture of the sheet. It is also advantageous to spread the elongate bodies well during the impregnation process or to subject them to for instance ultrasonic vibration. If multifilament yarns are used, it is important for a good spread that the yarns have a low twist. Furthermore, the matrix material may be applied in vacuo.

In one embodiment of the present invention, the sheet does not contain a matrix material. The sheet may be manufactured by the steps of providing a layer of elongate bodies and where necessary adhering the elongate bodies together by the application of heat and pressure. It is noted that this embodiment requires that the elongate bodies can in fact adhere to each other by the application of heat and pressure.

In one embodiment of this embodiment, the elongate bodies overlap each other at least partially, and are then compressed to adhere to each other. This embodiment is particularly attractive when the elongate bodies are in the form of tapes.

If so desired, a matrix material may be applied onto the sheets to adhere the sheets to each other during the manufacture of the ballistic material. The matrix material can be applied in the form of a film or, preferably, in the form of a liquid material, as discussed above for the application onto the elongate bodies themselves.

In one embodiment of the present invention, matrix material is applied in the form of a web, wherein a web is a discontinuous polymer film, that is, a polymer film with holes. This allows the provision of low weights of matrix materials. Webs can be applied during the manufacture of the sheets, but also between the sheets.

In another embodiment of the present invention, matrix material is applied in the form of strips, yarns, or fibers of polymer material, the latter for example in the form of a woven or non-woven yarn of fiber web or other polymeric fibrous weft. Again, this allows the provision of low weights of matrix materials. Strips, yarns or fibers can be applied during the manufacture of the sheets, but also between the sheets.

In a further embodiment of the present invention, matrix material is applied in the form of a liquid material, as described above, where the liquid material may be applied homogeneously over the entire surface of the elongate body plane, or of the sheet, as the case may be. However, it is also possible to apply the matrix material in the form of a liquid material inhomogeneously over the surface of the elongate body plane, or of the sheet, as the case may be. For example, the liquid material may be applied in the form of dots or stripes, or in any other suitable pattern.

In various embodiments described above, matrix material is distributed inhomogeneously over the sheets. In one embodiment of the present invention the matrix material is distributed inhomogeneously within the compressed stack. In this embodiment more matrix material may be provided there were the compressed stack encounters the most influences from outside which may detrimentally affect stack properties.

The organic matrix material, if used, may wholly or partially consist of a polymer material, which optionally may contain fillers usually employed for polymers. The polymer may be a thermoset or thermoplastic or mixtures of both. Preferably a soft plastic is used, in particular it is preferred for the organic matrix material to be an elastomer with a tensile modulus (at 25° C.) of at most 41 MPa. The use of non-polymeric organic matrix material is also envisaged. The purpose of the matrix material is to help to adhere the elongated bodies and/or the sheets together where required, and any matrix material which attains this purpose is suitable as matrix material.

Preferably, the elongation to break of the organic matrix material is greater than the elongation to break of the reinforcing elongate bodies. The elongation to break of the matrix preferably is from 3 to 500%. These values apply to the matrix material as it is in the final ballistic-resistant article.

Thermosets and thermoplastics that are suitable for the sheet are listed in for instance EP833742 and WO-A-91/12136. Preferably, vinylesters, unsaturated polyesters, epoxides or phenol resins are chosen as matrix material from the group of thermosetting polymers. These thermosets usually are in the sheet in partially set condition (the so-called B stage) before the stack of sheets is cured during compression of the ballistic-resistant molded article. From the group of thermoplastic polymers polyurethanes, polyvinyls, polyacrylates, polyolefins or thermoplastic, elastomeric block copolymers such as polyisoprene-polyethylenebutylene-polystyrene or polystyrene-polyisoprenepolystyrene block copolymers are preferably chosen as matrix material.

In the case that a matrix material is used in the compressed stack in accordance with the invention, the matrix material is present in the compressed stack in an amount of 0.2-40 wt. %, calculated on the total of elongate bodies and organic matrix material. The use of more than 40 wt. % of matrix material was found not to further increase the properties of the ballistic material, while only increasing the weight of the ballistic material. Where present, it may be preferred for the matrix material to be present in an amount of at least 1 wt. %, more in particular in an amount of at least 2 wt. %, in some instances at least 2.5 wt. %. Where present, it may be preferred for the matrix material to be present in a amount of at most 30 wt. %, sometimes at most 25 wt. %.

In one embodiment of the present invention, a relatively low amount of matrix material is used, namely an amount in the range of 0.2-8 wt. %. In this embodiment it may be preferred for the matrix material to be present in an amount of at least 1 wt. %, more in particular in an amount of at least 2 wt. %, in some instances at least 2.5 wt. %. In this embodiment it may be preferred for the matrix material to be present in a amount of at most 7 wt. %, sometimes at most 6.5 wt. %.

The compressed sheet stack of the present invention should meet the requirements of class II of the NIJ Standard—0101.04 P-BFS performance test. In a preferred embodiment, the requirements of class IIIc of said Standard are met, in an even more preferred embodiment, the requirements of class III are met, or the requirements of other classes, such as class IV. This ballistic performance is preferably accompanied by a low areal weight, in particular an areal weight in NIJ III of at most 19 kg/m2, more in particular at most 16 kg/m2. In some embodiments, the areal weight of the stack may be below 15 kg/m2, or even below 13 kg/m2. The minimum areal weight of the stack is given by the minimum ballistic resistance required.

In one embodiment, the Specific Energy Absorption (SEA) in these stacks may be higher than 200 kJ/(kg/m2). The SEA is understood to be the energy absorption upon impact of a bullet hitting the molded article at such a velocity that the probability of the molded article stopping the bullet is 50% ($V_{50}$), divided by the areal density (mass per $m^2$) of the molded article. The ballistic-resistant material according to the invention preferably has a peel strength of at least 5N, more in particular at least 5.5 N, determined in accordance with ASTM-D 1876-00, except that a head speed of 100 mm/minute is used.

Depending on the final use and on the thickness of the individual sheets, the number of sheets in the stack in the ballistic resistant article according to the invention is generally at least 2, in particular at least 4, more in particular at least 8. The number of sheets is generally at most 500, in particular at most 400.

In one embodiment of the present invention the direction of elongate bodies within the compressed stack is not unidirectionally. This means that in the stack as a whole, elongate bodies are oriented in different directions.

In one embodiment of the present invention the elongate bodies in a sheet are unidirectionally oriented, and the direction of the elongate bodies in a sheet is rotated with respect to the direction of the elongate bodies of other sheets in the stack, more in particular with respect to the direction of the elongate bodies in adjacent sheets. Good results are achieved when the total rotation within the stack amounts to at least 45 degrees. Preferably, the total rotation within the stack amounts to approximately 90 degrees. In one embodiment of the present invention, the stack comprises adjacent sheets wherein the direction of the elongated bodies in one sheet is perpendicular to the direction of elongated bodies in adjacent sheets.

The invention also pertains to a method for manufacturing a ballistic-resistant molded article comprising the steps of providing sheets comprising reinforcing elongate bodies, stacking the sheets and compressing the stack under a pressure of at least 0.5 MPa.

In one embodiment of the present invention the sheets are stacked in such a manner that the direction of the elongated bodies in the stack is not unidirectionally.

In one embodiment of this process, the sheets are provided by providing a layer of elongate bodies and causing the bodies to adhere. This can be done by the provision of a matrix material, or by compressing the bodies as such. In the latter embodiment it may be desired to apply matrix material onto the sheets before stacking.

The pressure to be applied is intended to ensure the formation of a ballistic-resistant molded article with adequate properties. The pressure is at least 0.5 MPa. A maximum pressure of at most 50 MPA may be mentioned.

Where necessary, the temperature during compression is selected such that the matrix material is brought above its softening or melting point, if this is necessary to cause the matrix to help adhere the elongate bodies and/or sheets to each other. Compression at an elevated temperature is intended to mean that the molded article is subjected to the given pressure for a particular compression time at a compression temperature above the softening or melting point of the organic matrix material and below the softening or melting point of the elongate bodies.

The required compression time and compression temperature depend on the kind of elongate body and matrix material and on the thickness of the molded article and can be readily determined by one skilled in the art.

Where the compression is carried out at elevated temperature, the cooling of the compressed material should also take place under pressure. Cooling under pressure is intended to mean that the given minimum pressure is maintained during cooling at least until so low a temperature is reached that the structure of the molded article can no longer relax under atmospheric pressure. It is within the scope of the skilled person to determine this temperature on a case by case basis. Where applicable it is preferred for cooling at the given minimum pressure to be down to a temperature at which the organic matrix material has largely or completely hardened or crystallized and below the relaxation temperature of the reinforcing elongate bodies. The pressure during the cooling does not need to be equal to the pressure at the high temperature. During cooling, the pressure should be monitored so that appropriate pressure values are maintained, to compensate for decrease in pressure caused by shrinking of the molded article and the press.

Depending on the nature of the matrix material, for the manufacture of a ballistic-resistant molded article in which the reinforcing elongate bodies in the sheet are high-drawn elongate bodies of high-molecular weight linear polyethylene, the compression temperature is preferably 115 to 135° C. and cooling to below 70° C. is effected at a constant pressure. Within the present specification the temperature of the material, e.g., compression temperature refers to the temperature at half the thickness of the molded article.

In the process of the invention the stack may be made starting from loose sheets. Loose sheets are difficult to handle, however, in that they easily tear in the direction of the elongate bodies. It may therefore be preferred to make the stack from consolidated sheet packages containing from 2 to 50 sheets. In one embodiment, stacks are made containing 2-8 sheets. In another embodiment, stacks are made of 10-30 sheets. For the orientation of the sheets within the sheet packages, reference is made to what has been stated above for the orientation of the sheets within the compressed stack.

Consolidated is intended to mean that the sheets are firmly attached to one another. Very good results are achieved if the sheet packages, too, are compressed.

The present invention is elucidated by the following examples, without being limited thereto or thereby.

Example

Three types of polyethylene tapes were used, one meeting the requirements of the present invention, and two tapes not meeting the requirements of the present invention. Tape properties are presented in Table 1. All tapes had a width of 1 cm.

| | Mw (gram/mole) | Mw/Mn | 200/110 | tensile strength |
|---|---|---|---|---|
| tape 1 (comparative) | 3.6 * 10^6 | 8.3 | 0.8 | 2.0 GPa |
| tape 2 (comparative) | 4.3 * 10^6 | 9.8 | 2.2 | 2.1 GPa |
| tape A (invention) | 2.7 * 10^6 | 3.2 | 5.0 | 3.45 GPa |

Test shields were manufactured as follows. Monolayers of adjacent tapes were prepared. The monolayers were provided with a matrix material. The monolayers were then stacked, with the tape direction of the tapes in adjacent monolayers being rotated with 90°. This sequence was repeated until a stack of 8 monolayers was obtained. The stacks were compressed for 10 minutes at a pressure of 40-50 bar at a temperature of 130° C. The thus-obtained test shields had a matrix content of about 5 wt. %, and a size of about 115×115 mm.

The shields were tested as follows. A shield is fixed in a frame. An aluminum bullet with a weight of 0.56 gram is fired at the center of the shield. The velocity of the bullet is measured before it enters the shield and when it has left the shield. The consumed energy is calculated from the difference in velocity, and the specific consumed energy is calculated. The results are presented in Table 2 below.

| | shield weight (g) | areal weight (kg/m2) | bullet velocity 1 (m/s) | bullet velocity 2 (m/s) | consumed energy (J) | SCE specific consumed energy (J) |
|---|---|---|---|---|---|---|
| Comparative tape 1 | 7.24 | 0.55 | 332 | 308 | 4.3 | 7.9 |
| Comparative tape 1 | 7.31 | 0.55 | 341 | 314 | 4.9 | 8.9 |
| Comparative tape 2 | 5.37 | 0.41 | 329 | 310 | 3.4 | 8.3 |
| Comparative tape 2 | 6.01 | 0.50 | 332 | 308 | 4.4 | 8.7 |
| Invention tape A | 3.36 | 0.25 | 337 | 318 | 3.5 | 13.8 |
| Invention tape A | 2.91 | 0.22 | 343 | 328 | 2.9 | 13.0 |

As can be seen from Table 2, the use of a tape with a molecular weight of at least 100,000 gram/mole and a Mw/Mn ratio within the claimed range shows a substantial increase in specific energy adsorption. This means that this material shows an improved ballistic performance, allowing the manufacture of lower weight shields with good ballistic properties, and other ballistic materials. It is interesting to note that even though the tapes meeting the requirements of the invention have a lower molecular weight than the tapes with comparative properties, they still show improved ballistic results.

The invention claimed is:

1. A ballistic-resistant molded article comprising a compressed stack of sheets comprising:

reinforcing elongate bodies, wherein at least some of the elongate bodies are polyethylene elongate bodies which have a weight average molecular weight of at least 100,000 gram mole and a modulus of at least 150 GPa, wherein when polyethylene elongate bodies are tapes, they have a 200/110 uniplanar orientation parameter of least 3, and, when the elongate bodies are fibers, they have a 020 uniplanar orientation parameter of at most 55°.

2. The ballistic-resistant molded article according to claim 1, wherein the polyethylene elongate bodies have a weight average molecular weight of at least 300,000 gram/mole.

3. The ballistic-resistant molded article according to claim 1, wherein the elongate bodies in at least one of the sheets are unidirectionally oriented.

4. The ballistic-resistant molded article according to claim 3, wherein the direction of the elongate bodies in a sheet is oriented in a different direction from a direction of the elongate bodies in an adjacent sheet.

5. The ballistic-resistant molded article according to claim 1, wherein the elongate bodies are tapes.

6. The ballistic-resistant molded article according to claim 1 herein the elongate bodies have a tensile strength of at least 2.0 GPa.

7. The ballistic-resistant molded article according to claim 6, wherein the elongate bodies have a tensile strength of at least 2.5 GPa.

8. The ballistic-resistant molded article according to claim 7, wherein the elongate bodies have a tensile strength of at least 3.0 GPa.

9. The ballistic-resistant molded article according to claim 8, wherein the elongate bodies have a tensile strength of at least 4.0 GPa.

10. The ballistic-resistant molded article according to claim 1, wherein the elongate bodies have a tensile energy to break of at least 35 J/g.

11. The ballistic-resistant molded article according to claim 10, wherein the elongate bodies have a tensile energy to break of at least 40 J/g.

12. The ballistic-resistant molded article according to claim 11, wherein the elongate bodies have a tensile energy to break of at least 50 J/g.

13. The ballistic-resistant molded article according to claim 1, further comprising a matrix material in an amount of 0.2-40 wt.%, calculated on the total wt. of elongate bodies and matrix material, wherein the matrix material is located in at least one sheet, between at least two sheets, or both.

14. The ballistic-resistant molded article according to claim 13, wherein at least some of the sheets are substantially free from the matrix material and the matrix material is present between the sheets.

15. A consolidated sheet package suitable for use in the manufacture of a ballistic-resistant molded article comprising a compressed stack of sheets comprising reinforcing elongate bodies, the consolidated sheet package comprising:

2-50 sheets, each sheet comprising reinforcing elongate bodies, the direction of the elongate bodies within the sheet package being not unidirectional, wherein at least some of the elongate bodies are polyethlene elongate bodies which have a weight average molecular weight of at least 100,000 gram/mole and a modulus or at least 150 GPa, when polyethlene elongate bodies are tapes, they have a 200/110 uniplanar orientation parameter of at least 3, and, when the elongate bodies are fibers, they have a 020 uniplanar orientation parameter of at most 55°.

16. A method for manufacturing a ballistic-resistant molded article comprising:

providing sheets comprising reinforcing elongate bodies, stacking the sheets in such a manner that the direction of the elongate bodies within the stack is not unidirectional, and compressing the stack under a pressure of at least 0.5 MPa, wherein at least some of the elongate bodies are polyethylene elongate bodies which have a weight average molecular weight of at least 100,000 gram/mole and a modulus of at least 150 GPa, and when polyethylene elongate bodies are tapes, they have a 200/110 uniplanar orientation parameter of at least 3, and, when the elongate bodies are fibers, they have a 020 uniplanar orientation parameter of at most 55°.

17. The method according to claim 16, wherein the sheets are provided by providing a layer of elongate bodies and causing the elongate bodies to adhere.

18. The method according to claim 17, wherein the elongate bodies are caused to adhere by the provision of a matrix material, and wherein the matrix material is located in at least one sheet, between at least two sheets, or both.

19. The method according claim 17, wherein the elongate bodies are caused to adhere via compression.

* * * * *

UNITED STATES PATENT AND TRADEMARK OFFICE

CERTIFICATE OF CORRECTION

PATENT NO. : 8,535,800 B2
APPLICATION NO. : 13/467729
DATED : September 17, 2013
INVENTOR(S) : Soon Joo Bovenschen et al.

It is certified that error appears in the above-identified patent and that said Letters Patent is hereby corrected as shown below:

In the Specification

Column 5, line 53, "(Gael mirror)" should be --(Göbel mirror)--.

Column 9, line 39, "Suitable methods for" should begin on line 40 as a new paragraph.

Column 15, line 44, "class IIIc" should be --class IIIa--.

In the Claims

Column 18, Claim 1, line 35, "gram mole" should be --gram/mole--.

Signed and Sealed this
Third Day of December, 2013

Margaret A. Focarino

Margaret A. Focarino
*Commissioner for Patents of the United States Patent and Trademark Office*